US008726784B2

(12) United States Patent
Dawson et al.

(10) Patent No.: US 8,726,784 B2
(45) Date of Patent: May 20, 2014

(54) FIELD GUN AIM

(71) Applicant: BAE SYSTEMS plc, London (GB)

(72) Inventors: Keith Dawson, Barrow in Furness (GB); Frederick Herbert, Barrow in Furness (GB); John Michael Webb, Barrow in Furness (GB)

(73) Assignee: BAE SYSTEMS plc (GB)

( * ) Notice: Subject to any disclaimer, the term of this patent is extended or adjusted under 35 U.S.C. 154(b) by 0 days.

(21) Appl. No.: 13/708,605

(22) Filed: Dec. 7, 2012

(65) Prior Publication Data

US 2014/0102286 A1 Apr. 17, 2014

(30) Foreign Application Priority Data

Oct. 10, 2012 (GB) ..... 1218115.2

(51) Int. Cl.

| | |
|---|---|
| ***F41A 23/28*** | (2006.01) |
| ***F41A 23/46*** | (2006.01) |
| ***F41A 25/00*** | (2006.01) |
| ***F41A 25/22*** | (2006.01) |

(52) U.S. Cl.

CPC ..... *F41A 23/28* (2013.01); *F41A 23/46* (2013.01); *F41A 25/00* (2013.01); *F41A 25/22* (2013.01)

USPC ..... 89/40.03; 89/40.04; 89/40.09

(58) Field of Classification Search

CPC ..... F41A 23/24; F41A 23/28; F41A 23/46; F41A 25/00; F41A 23/34; F41A 25/02; F41A 25/04; F41A 25/22; F41A 25/24

USPC ..... 89/40.03, 40.04, 40.011, 40.09

See application file for complete search history.

(56) References Cited

U.S. PATENT DOCUMENTS

| | | | | | |
|---|---|---|---|---|---|
| 1,358,386 | A | * | 11/1920 | Moriarty | 89/43.02 |
| 3,366,009 | A | * | 1/1968 | Aldrin | 89/40.11 |
| 3,598,016 | A | * | 8/1971 | Chiabrandy et al. | 89/157 |
| 5,210,370 | A | | 5/1993 | Mraz et al. | |
| 6,024,007 | A | | 2/2000 | Searle et al. | |

(Continued)

FOREIGN PATENT DOCUMENTS

| | | |
|---|---|---|
| EP | 0 695 925 A1 | 2/1996 |
| FR | 1 425 261 | 1/1966 |
| GB | 2 313 179 A | 11/1997 |

OTHER PUBLICATIONS

Search Report dated Feb. 7, 2013, issued in corresponding United Kingdom Patent Application No. 1218115.2. (3 pages).

(Continued)

*Primary Examiner* — Stephen M Johnson
(74) *Attorney, Agent, or Firm* — Finch & Maloney PLLC

(57) ABSTRACT

A howitzer suitable for deployment on a ground plane, the howitzer having an ordnance for firing a projectile. The ordnance can include a barrel defining a barrel axis and having a muzzle towards the front end of the howitzer and a breech assembly at the back end of the barrel; a cradle for holding the ordnance at a traverse and an elevation; two trunnion pins located on the cradle, which co-locate with receiving trunnion bearings on a saddle, wherein in a first position said breech is located forward of the trunnion, in a second position, at the end of the recoil stroke, the breech is retracted substantially behind the trunnion, wherein a recoil stroke is variable depending on the selection of the elevation.

6 Claims, 6 Drawing Sheets

(56) References Cited

U.S. PATENT DOCUMENTS

| | | | |
|---|---|---|---|
| 6,178,866 | B1 | 1/2001 | Searle et al. |
| 8,061,259 | B1 | 11/2011 | Searle et al. |
| 2008/0053301 | A1 | 3/2008 | Balbo |

OTHER PUBLICATIONS

Jan. 23, 2014 European Search Report issued in European Application No. 12275174.6.

Jan. 24, 2014 International Search Report and Written Opinion issued in PCT/GB2013/000424.

* cited by examiner

FIELD GUN AIM

The following invention relates to a howitzer and particularly to a split lift light weight howitzer for a modular solution.

The ordnance is the component of the howitzer that launches the projectile.

In certain known howitzers (such as the L118 Light Gun that fires 105 mm rounds) the ordnance is aimed (i.e. has traverse or elevation varied) using a carriage and soleplate arrangement. In such typical howitzers the soleplate is a plate-like platform that sits on the ground so as to bear the weight of the Gun and oppose any forward tipping moments; forward tipping moments are greatest during counter recoil. The soleplate is provided with a carriage mounted on top. The soleplate and carriage are connected by a swivel joint, thus the carriage can swivel in the plane of the ground (e.g. when the ground is horizontal, the carriage will swivel in a horizontal plane) so as to vary the ordnance traverse. The carriage is connected to the ordnance by way of trunnions that extend laterally from the cradle thus the ordnance can rotate about the trunnion/saddle connection to vary the elevation.

In use, such howitzers rest on the ground with the ordnance having a breech end generally towards the rear of the howitzer and a muzzle end pointing in a generally forwards direction.

It is known that howitzers are desired to be lightweight. Lightweight howitzers are desirable because they can be transported by a wider range of vehicles and because a greater number of them may be carried by a given transport vehicle. Thus lightweight howitzers can be deployed faster than heavier alternatives. However, current light weight howitzers are typically based on 105 mm shells, and whilst readily deployable, there is a requirement to move towards 155 mm ammunition such that fewer rounds are required to achieve the same effect. However, the recoil forces and size of general conventional 155 mm Howitzers are very large and heavy and are restricted in their capability to being transported by main stream helicopter air lifting capabilities.

Before the present invention is described in further detail, it is to be understood that the invention is not limited to the particular embodiments described, and as such may, of course, vary. It is also to be understood that the terminology used herein is for the purpose of describing particular embodiments only, and is not intended to be limiting, since the scope of the present invention will be limited only by the appended claims.

According to a first aspect of the invention there is provided a split lift howitzer, the howitzer comprising:

i) An elevating mass comprising:
   a) an ordnance for firing a projectile, the ordnance comprising a barrel defining a barrel axis and having a muzzle towards the front end of the howitzer and a breech assembly at the rear end of the barrel; and
   b) a cradle for holding the ordnance at a traverse and an elevation; and
   c) two trunnion pins located on said cradle, which co-locate with receiving trunnion bearings on a saddle,
ii) wherein in a first position said breech is located forward of said trunnion,
iii) in a second position, said breech is retracted substantially behind said trunnion,
iv) wherein said recoil stroke is variable depending on the selection of the elevation.

The breech lies in front of the trunnion in the first position, particularly during the loading phase, and so remains consistently accessible, without the need to dig a pit such that the breech may be accessible at high elevations.

In the second position, typically after firing and during the recoil the breech retracts behind the trunnions. This permits an extended travel path for the barrel to travel along, thus increasing the mitigation of the firing impulse.

Preferably the howitzer is a reduced mass howitzer. In a highly preferred arrangement the barrel has a sub-optimal length. The ability to be carried by helicopters partially arises by using a sub-optimal barrel length. Very well-known and documented typical barrel lengths are L39 or L52, wherein the length of the barrel is 39× or 52×the diameter of the munition.

Preferably the barrel length is L30, 30× the diameter of the munition, this allows for a significant reduction in weight. L30 barrels for 155 mm systems have been used on main battle tanks in, where very significant masses of the vehicle prevent instability.

However, for lightweight, helicopter transportable, such as, for example, split lift howitzers, the disadvantage is that there is now less mass to resist the recoiling energy generated during gun fire. The firing impulse causes the ordnance to recoil. This force has to be resisted, which in turn produces significant forces within the weapon structures and impacts the dynamic stability of the weapon system. To reduce the overturning moment generated when firing at low gun elevations the geometry of the gun is designed such that the gun trunnions are very low to the ground and the breech mounted well forward of the gun trunnions. In order to further compensate for the lack of mass there is an extended length recoil stroke, and this is achieved by allowing the breech to recoil past the gun trunnions, in the second position.

The trunnions are positioned rearward on the saddle, which results in less system mass behind the trunnion and more in front to assist stability. Maintaining the centre of gravity of the system well forward allows the mass moment of inertia of the system to resist rotation during firing due to the overturning moment.

The very low trunnion height and the long and variable recoil stroke mitigate the firing forces, and increase stability. Preferably, the trunnions overhang the body on the lower carriage, when mounted on a lower carriage assembly, to allow breech to recoil clear of the structures at high elevations.

The cradle houses the ordnance, and comprises a front bridge portion which houses and slidably engages with a portion of said barrel, if further retains a piston rod of a recoil brake and a piston rod of a recuperator. The barrel is profiled to provide mounting interfaces for the recoil system, recoil brake and recuperator, to attach to it. Mounting the recoiling parts by this method allows their weight impact on the recoiling mass to be maximised and reduce recoil velocity and force. Preferably, the recoil brake is mounted on top of the barrel and the recuperator below the barrel.

In a preferred arrangement a pair of combined elevation and balance actuators are located between the saddle and the cradle.

The split lift is an ordnance system wherein the traversing mass may be separated from the lower platform. The traversing mass comprises the ordnance, cradle and saddle assemblies. Preferably the saddle has at least one co-operative engagement means, for linking said saddle to a lower platform such as, for example a towable lower carriage assembly, a fixed forward operating base, a track mounted base within an ISO containerised system or self-propelled arrangement.

In a towable arrangement, the towable lower carriage assembly comprises;

a body unit, comprising a pintle for engaging with said saddle, a pair of front stabilisers, pivotally connected to said body;
a pair of rear trails pivotally connected to said body;
a pair of wheels substantially co-axially aligned with the barrel axis; as determined when in a towed/mobile arrangement.

In a highly preferred arrangement said rear trails comprise a trail leg, a trail arm which is pivotally connected to said trail leg, a spade and a damper, wherein said damper is located between the trail leg and trail arm. The trail arm and spade act as a single unit but they can be disconnected to ease removal of the spade from the ground during displacement of the gun.

The trail leg is required to maintain the rearward position of the spades relative to the trunnions in order to achieve stability, particularly when firing at low elevation. A damper is fitted into the trail leg and when deployed in the firing position the damper piston seats against the underside of the trail arm. The damper provides resilience between the leg and the arm and allows the spade to rotate about the trail leg/arm hinge to self-dig into the ground during firing.

In the firing mode, the rotation about the pintle and elevation is controlled by the user, however, it is essential that when the gun is converted to a travelling or mobility mode that certain movements are restricted or preferably prohibited, such that the system further comprises i. a traverse lock, located between the saddle and body, to prevent rotation about said pintle,
ii. an elevation lock, located between the cradle and saddle, to prevent elevation movement of the ordnance with respect to the lower carriage.

According to a further aspect of the invention there is provided a method of transforming a howitzer as defined herein, from a firing mode to a travelling mode, comprising the steps of i. engaging the traverse lock between the saddle and body to prevent rotation of the ordnance about the pintle,
ii. engaging the elevation lock between the cradle and saddle to prevent elevation of the ordnance with respect to the carriage.
iii. pivoting the front stabilisers and stowing them in a rearwards direction
iv. pivoting the spade and trail arm upwards and in a general forwards orientation
v. pivoting the trail legs inwardly towards said body.

Preferably the front stabilisers extend to rest on the ground at a foremost ground contact point and the rear trails extend to rest on the ground at a backmost ground contact point such that the foremost ground contact point is situated below the barrel and substantially forwards of the howitzer's centre of gravity so as to be able to oppose the tipping moment induced during counter-recoil.

Beneficially the front stabilisers and rear trails are therefore at the periphery of the howitzer's ground base and so they can oppose the forces that the howitzer experiences during firing so that the howitzer does not topple.

An exemplary embodiment of the invention now will be described with reference to the following figures, of which:

Figure 9:
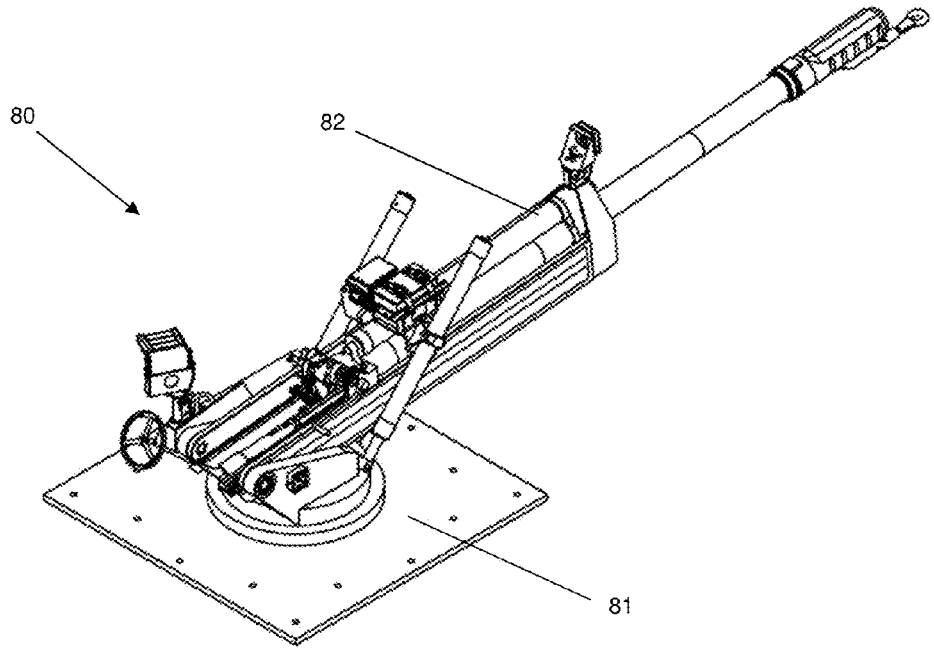
FIG. 9 shows a forward operating base mounted howitzer.
Figure 10A:
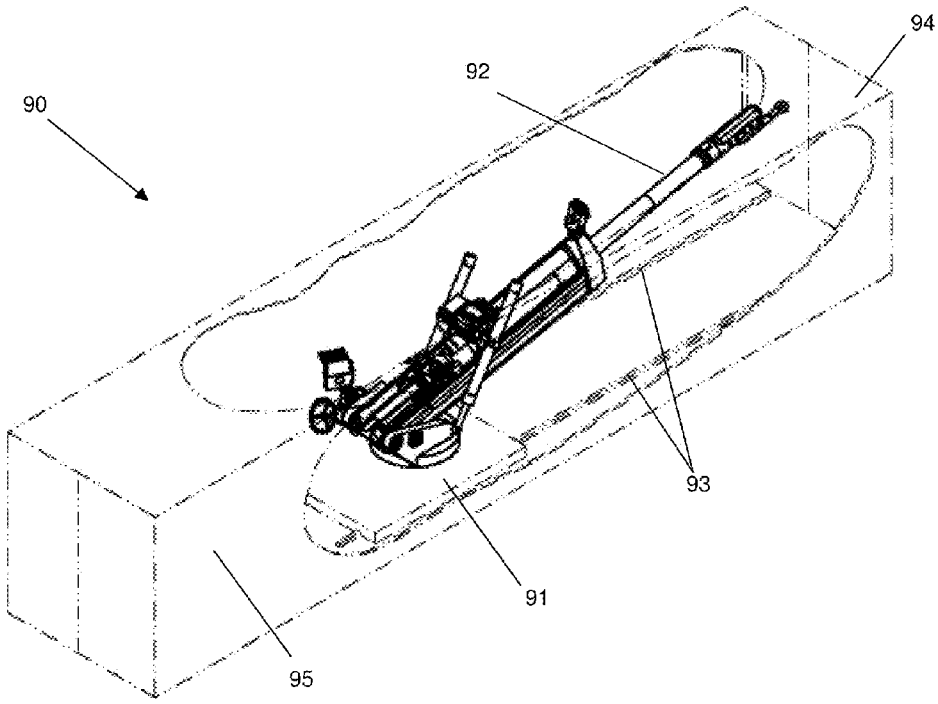
Figure 10B:
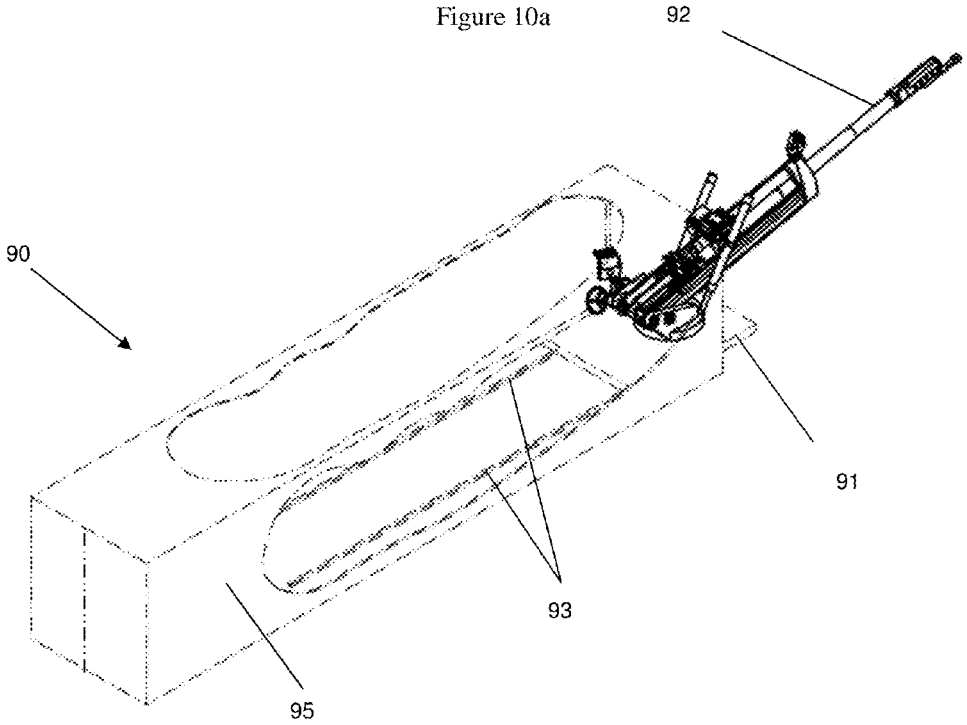

FIGS. 10*a* and 10*b* show the howitzer in FIG. 9, located on rails within an ISO container, for ready deployment.

Figure 1:
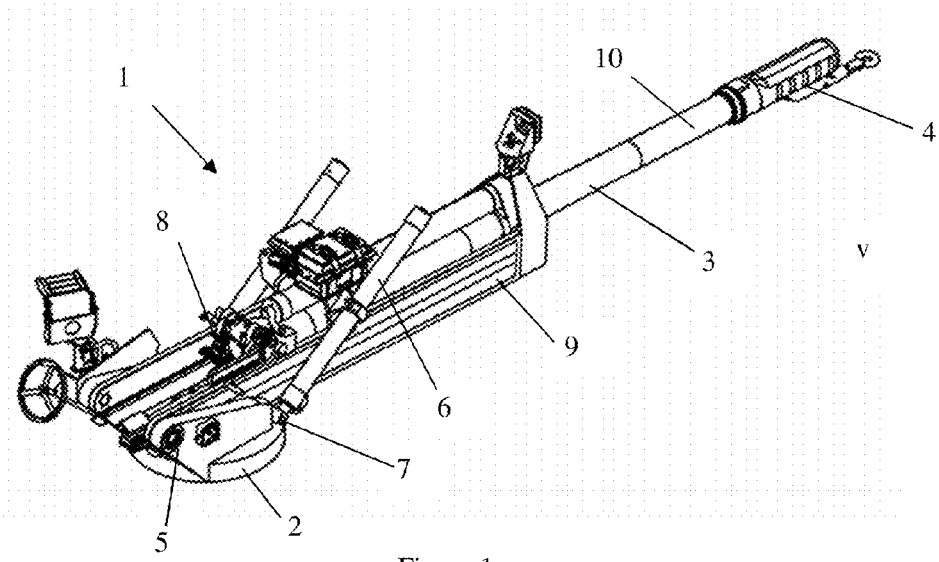
FIG. 1 shows a side projection of an exemplary traversing mass of a howitzer.

Turning to FIG. 1, the howitzer 1, generally consists of the saddle 2, which supports the cradle 9, the cradle 9 is pivotally linked to the saddle assembly 2 via trunnions 5. The cradle 9 supports the ordnance 3. The ordnance comprises a barrel 10, breech 8 and at the muzzle end there is a muzzle brake 4, said muzzle brake comprising a towing pintle to allow connection to a vehicle (not shown). A pair of combined elevation and balance (CB&E) actuators 6, are connected, at fixture point 7 on the saddle 2 and connect to the cradle 9.

The ordnance 3 is retained by cradle 9 which surrounds the axis of the barrel 10 at the breech end 8. The cradle 9 is provided with a recoil mechanism (indicated more clearly in FIG. 4) so that when a 155 mm calibre projectile is fired, the ordnance 3 can move backwards through the cradle 9 along the barrel axis, the recoil mechanism also reacts against the firing impulse.

Figure 2:
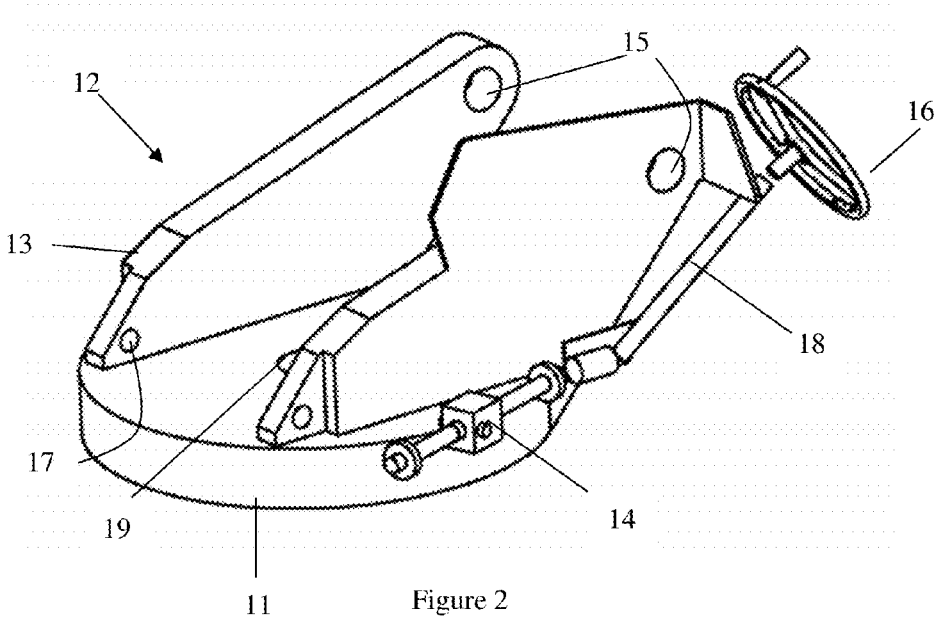
FIG. 2 shows the saddle of the howitzer of FIG. 1.

FIG. 2 shows a side projection of the saddle 12, and comprises a base 11 and two side arms 13. The base mounts the traverse bearing 19 that interfaces to a lower carriage or lower assembly (examples shown in FIGS. 5-10*a*) and each side arm 13 mounts trunnion bearings 15 that support the elevating mass (ordnance and cradle) and allow it to pivot in elevation for pointing the weapon. The saddle arms 13 are swept back, rearwards, such that they overhang the saddle base 11.

The traverse drive 14 comprises a leadscrew unit mounted on the left hand side of the saddle 12 driven from a handwheel 16 through a connecting shaft 18. The nut on the leadscrew unit is connected to the lower carriage (not shown) and can be easily disconnected from it. Each side arm 13 also provides a mounting point 17 for the piston rods of the combined elevation and balance (CB&E) actuators (not shown).

Figure 3:
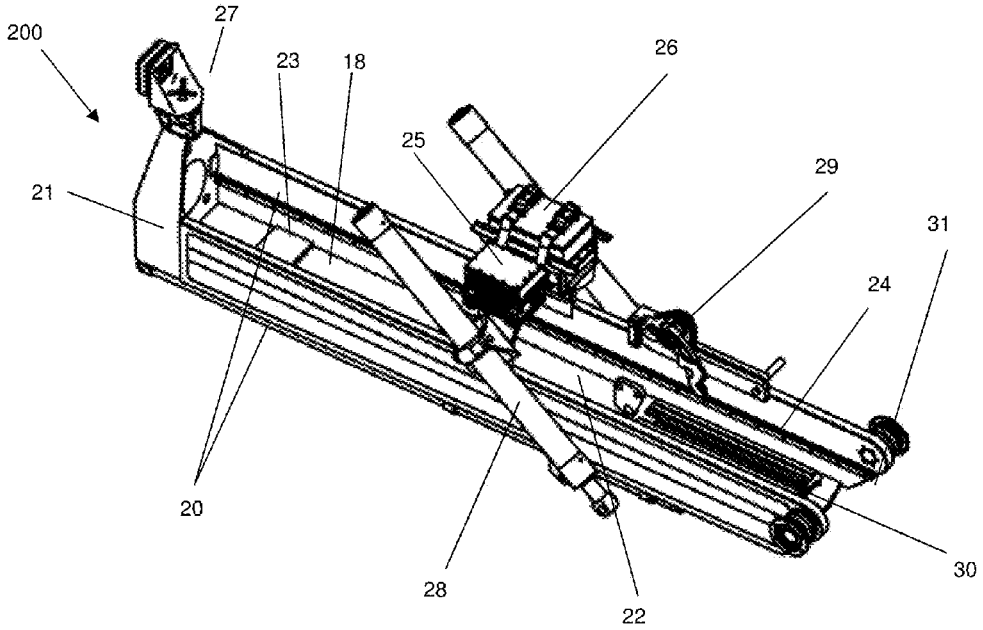
FIG. 3 shows a top down view of the cradle of the howitzer of FIG. 1, without the ordnance.

Turning to FIG. 3, the cradle structure 200 (with ordnance removed) comprises two side plates 20 that are secured at the forward end by a front bridge casting 21 together with upper 22 and lower bridge 23 members fitted along the length of the cradle. The inner face of each side plate 20 mounts a guideway 24 that mates with the slides on the body of the recuperator (not shown).

The loading tray assembly 30 is mounted to the two rear lower bridges 23. The assembly comprises a tray with a four bar linkage to lower and raise it into alignment with the barrel. The rear of the tray mounts a spring loaded latch and two rubbing strips run the length of the tray to assist the projectile to slide into the barrel.

A the rear of the cradle 200, is located the two trunion pins 31, which co-operatively and pivotally engage with the trunnion bearings on the saddle (shown as 15, FIG. 2)

The upper bridge member 22 mounts the inertial navigation 25 and battery 26 units that are part of a digital fire control system. The front bridge 21 mounts the muzzle velocity measuring device 27.

The cradle 200 mounts external supports on the left and right hand side for the CB&E actuators 28. The right hand side of the cradle mounts the roller mechanism for opening the breech block 29. The cradle also mounts the operating mechanism for the recoil brake elevation cut-off gear, the temperature compensation system (neither shown) and the CB&E accumulators 28.

Figure 4:
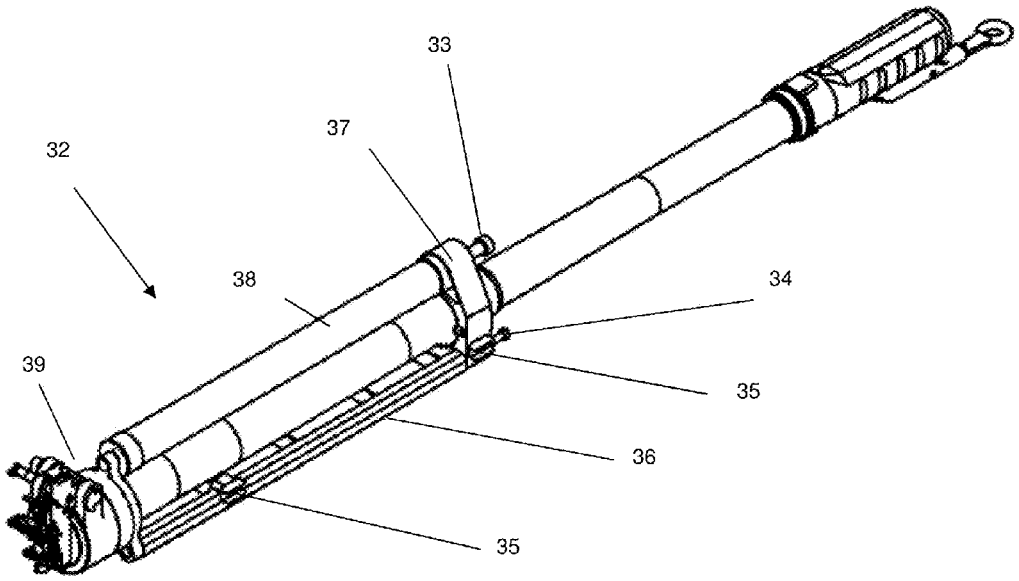
FIG. 4 shows a side projection of the ordnance and recoil system according to the invention.

Turning to FIG. 4, shows the recoiling mass 32 (which is formed of the ordnance and recoil system assembly). The recoil system is a hydro-pneumatic system comprising a recoil brake 38 and recuperator 36. To maximise stability of the gun and minimise forces imparted to the structures the recoil brake has a variable recoil stroke. At low elevation angles, less than 30 degrees, the recoil brake 38 stroke is maximised to minimise recoil force and overturning moments. At higher elevation angles the overturning moment on the weapon is reduced as the recoil force becomes more vertical relative to the lower carriage. Therefore, above 30 degrees the recoil stroke can be shortened through the operation of the elevation cut-off gear and an increase in recoil force is accepted. This reduction in recoil stroke also avoids the need to dig a gun pit to avoid the breech 39 hitting the ground.

The recoil brake piston rods 33 and recuperator piston rods 34 are attached to the front bridge casting 37 which forms part of the cradle 200. The cylinder bodies recoil brake 38 and recuperator 36 are attached to the barrel. To control the path of the recoil stroke the recuperator body mounts two slides 35 that run on guideways (shown as 24, FIG. 3) on the inner face of the cradle side plates.

To optimise the balance of the recoiling mass distribution around the barrel centreline the recoil brake 38 is mounted on top of the barrel and the recuperator 36 below.

The barrel is profiled to provide mounting interfaces for the recoil system, recoil brake 38 and recuperator 36, to attach to it. Mounting the recoiling parts by this method allows their weight impact on the recoiling mass to be maximised and reduce recoil velocity and force. The breech assembly 39 comprises the ring, block, operating mechanism and primer fed mechanism (PFM).

Figure 5:
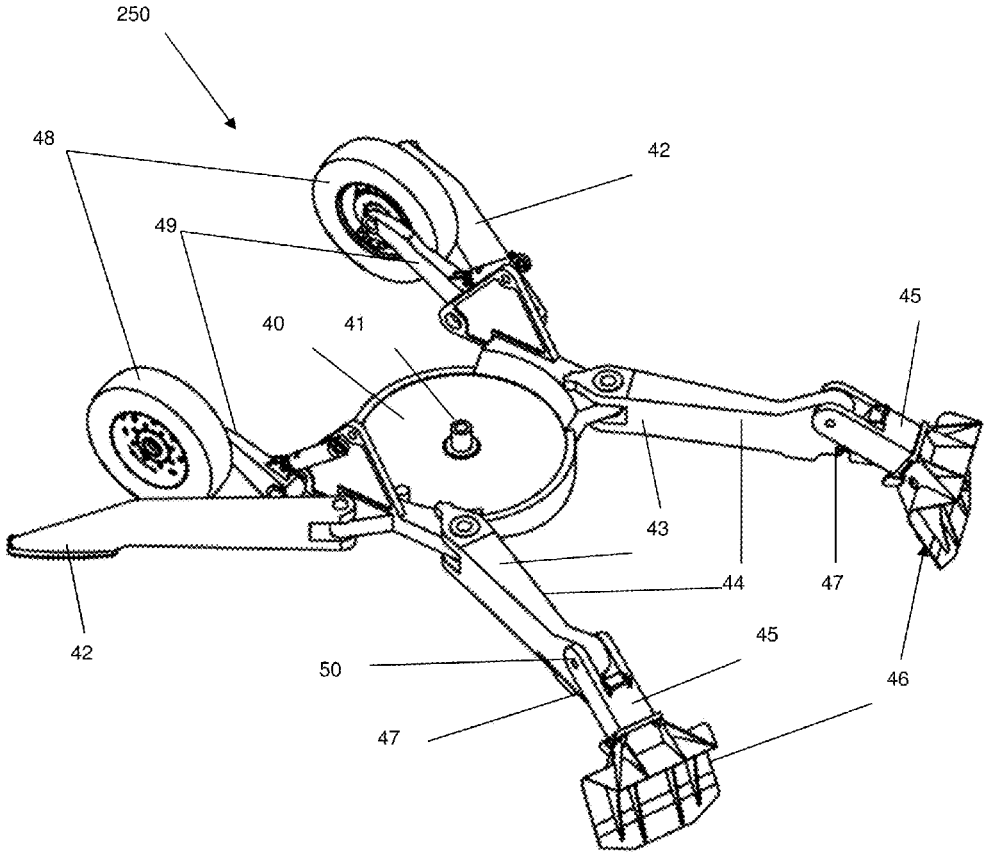
FIG. 5 shows a top down view of the lower carriage assembly.

Turning to FIG. 5, the lower carriage 250 is formed from a body structure 40. A pintle 41, integrated into the centre of the body 40 provides the mounting interface for the saddle and traverse bearing (shown as 19, FIG. 2). At the forward end of the body is mounted the front stabilizers 42 and at the rear, the rear trails 43. Each rear trail 43 consists of a trail leg 44, trail arm 45 and spade 46. The trail arm 45 and spade 46 act as a single unit but they can be disconnected to ease removal of the spade from the ground during displacement of the carriage 250.

The trail leg 44 is required to maintain the rearward position of the spades 46 relative to the trunnions in order to achieve stability, particularly when firing at low elevation. A damper 47 is fitted into the trail leg 44 and when deployed in the firing position the damper piston seats against the underside of the trail arm 45. The damper 47 provides resilience between the leg 44 and the arm 45 and allows the spade 46 to rotate about the trail leg/arm hinge 50 and to self dig into the ground during firing.

The body structure 250 also mounts the wheels 48, suspension systems 49 and braking systems (not shown). The suspension system 49 comprises right and left hand units with hydro-pneumatic suspension struts and road arms (not shown). The suspension system is a leading arm configuration with both the road arm pivot and the suspension strut mounted to the body 40.

Figure 6:
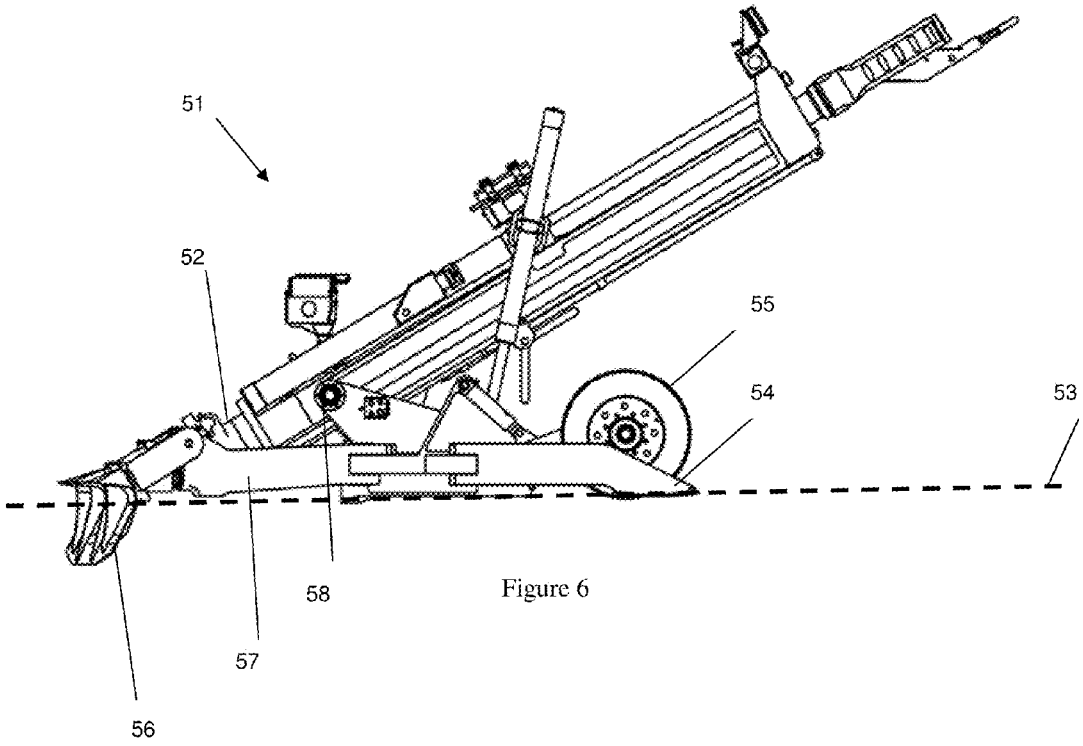
FIG. 6 shows a side view of the towable howitzer on a ground plane at maximum recoil.

Turning to FIG. 6, the howitzer 51 is mounted on a lower carriage. The howitzer is shown on a ground plane 53, with front stabilizers 54, and front wheels 55, in contact with the ground plane 53. The rear trails 57 are deployed and spades 56 are shown dug-in under the ground plane 53.

The howitzer 51 is shown in a fully recoiled state, and it can be clearly seen that the recoil of the breech 52, is past the trunnions 58.

Figure 7:
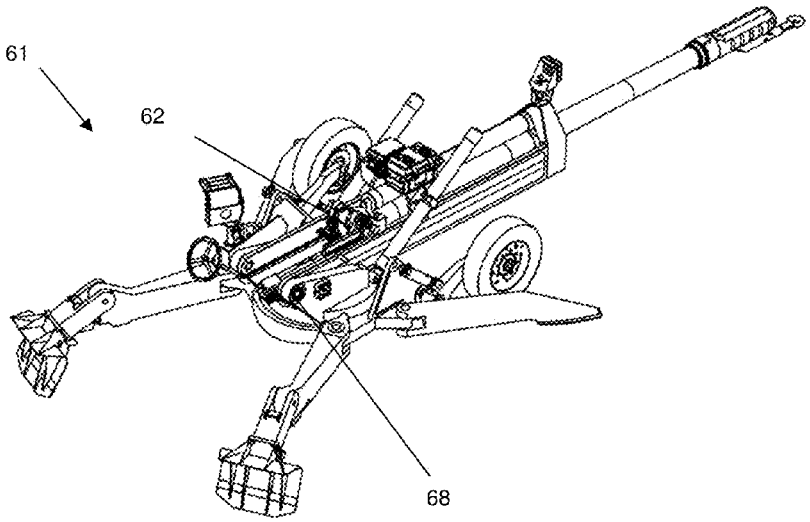
FIG. 7 shows a side elevation of the towable howitzer, with the ordnance in the loading position.

Turning to FIG. 7, the howitzer 61 in a side projection, shows the howitzer gun in a loading position, where the breech 62, is forward of the trunnions 68.

Considering FIGS. 6, 7, the split lift gun has a significantly shortened barrel and as mentioned above, the shorter barrel reduces the mass, which allows for easier transportation, but at a penalty of mitigating recoil. The recoil of the breech past the trunnion and the position of the self digging spades, provides the required stability to the shortened barrel howitzer.

Figure 8:
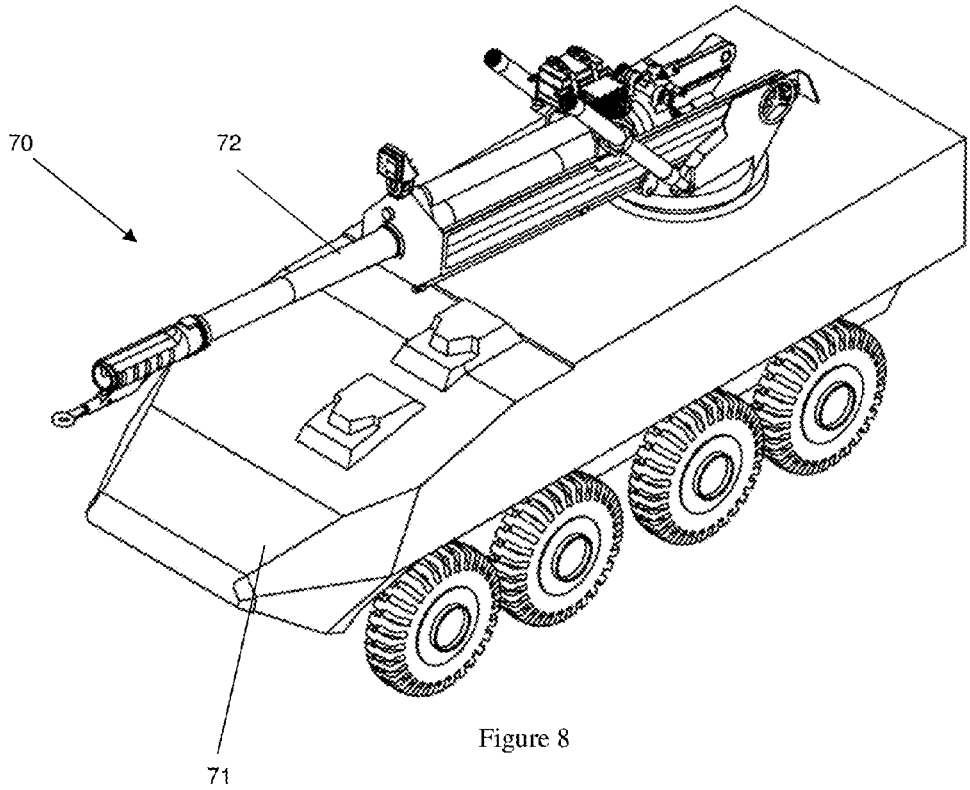
FIG. 8 shows a vehicle mounted howitzer.

FIG. 8 shows a side projection of a self propelled howitzer 70, a howitzer gun 72 is located on a vehicle 71.

FIG. 9 shows a side projection of a forward operating base howitzer 80, a howitzer gun 82 is located on a mounting plate 81, which may be affixed to a permanent or semi-permanent fixture or structure.

FIGS. 10*a* and 10*b* show a side projection of a containerised gun system 90, a howitzer gun 92 is located on a slidable mounting plate 91, which may be located in rails or guides 93. The doors 94 of the container 96 may be opened and the howitzer slid to the opened end and fired from within the container. This allows for very easy transportation of the gun system.

The components of the howitzer are fabricated from materials which are able to withstand the peak stresses and the cyclic loads that will be experienced in operation. In relation to this, the form of the components will be chosen according to the same criteria. The materials and forms will be chosen to minimise weight without compromising the strength. Given this, various steel alloys, titanium alloys and composites may, for example, be suitable materials. The man skilled in the art of howitzer design would be able to decide which materials and forms would be best in the circumstances.

Whilst the example described above relates specifically to a 155 mm calibre round, the invention is in no way limited to any particular calibre. For example, a howitzer according to this invention could be for firing 105 mm rounds.

Further variants within the scope of the invention would be obvious to the skilled man.

The invention claimed is:

1. A split lift howitzer, comprising:

i) an elevating mass including:

a) an ordnance for firing a projectile, the ordnance including a barrel defining a barrel axis and having a muzzle towards a front end of the howitzer and a breech assembly at a rear end of the barrel; and b) a cradle for holding the ordnance at a traverse and an elevation, wherein the cradle includes a front bridge portion which engages with a piston rod of a recoil brake and a piston rod of a recuperator, and the recoil brake is mounted on top of the barrel and the recuperator is mounted below the barrel; and c) two trunnion pins of a trunnion located on said cradle, which co-locate with receiving trunnion bearings on a saddle;

ii) wherein in a first position said breech assembly is located forward of said trunnion;

iii) in a second position said breech assembly is retracted substantially behind said trunnion; and iv) wherein a recoil stroke is variable depending on a selection of elevation.

2. A howitzer according to claim 1, wherein a pair of combined elevation and balance actuators are located between the saddle and the cradle.

3. A howitzer according to claim 1, wherein the saddle comprises:

at least one co-operative engagement unit that links said saddle to a towable lower carriage assembly, a fixed forward operating base, a track mounted base within a containerised system or self-propelled arrangement.

4. A howitzer according to claim 3 wherein the towable lower carriage assembly comprises; a body unit, comprising a pintle for engaging with said saddle, a pair of front stabilisers, pivotally connected to said body;

a pair of rear trails pivotally connected to said body;

a pair of wheels substantially co-axially aligned with the barrel axis.

5. A howitzer according to claim 4 wherein said rear trails comprise:

a trail leg, a trail arm which is pivotally connected to said trail leg, a spade and a damper, wherein said damper is located between the trail leg and trail arm.

6. A howitzer according to claim 1, wherein the barrel is of sub-optimal length.

* * * * *